US006611416B1

(12) United States Patent
Cleereman et al.

(10) Patent No.: US 6,611,416 B1
(45) Date of Patent: Aug. 26, 2003

(54) SAFETY RELAY CIRCUIT FOR LARGE POWER CONTACTORS

(75) Inventors: Douglas P. Cleereman, Greendale, WI (US); William J. Mayer, Hales Corners, WI (US); David S. Fisher, Brookfield, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/143,588

(22) Filed: May 10, 2002

(51) Int. Cl.[7] ..... H01H 47/00
(52) U.S. Cl. ..... 361/189; 361/166; 361/192
(58) Field of Search ..... 361/93, 85, 86, 361/100, 102, 189, 166, 192

(56) References Cited

U.S. PATENT DOCUMENTS

| | | | | |
|---|---|---|---|---|
| 3,249,820 A | | 5/1966 | Stimmel | |
| 4,152,634 A | * | 5/1979 | Penrod | 318/739 |
| 4,897,606 A | | 1/1990 | Cook et al. | |
| 5,281,857 A | | 1/1994 | Keese | |
| 5,689,398 A | | 11/1997 | Miller et al. | |
| 5,896,289 A | | 4/1999 | Struger | |
| 6,108,179 A | | 8/2000 | Katae et al. | |
| 6,301,091 B1 | | 10/2001 | Zomchek et al. | |

FOREIGN PATENT DOCUMENTS

JP 2002015654011 * 1/2002 ..... H01H/50/54

* cited by examiner

*Primary Examiner*—Brian Sircus
*Assistant Examiner*—Boris Benenson
(74) *Attorney, Agent, or Firm*—Quarles & Brady; Alexander M. Gerasimow; William R. Walbrun

(57) ABSTRACT

An apparatus and method for monitoring main contacts and auxiliary contacts of a power contactor is disclosed. The apparatus includes four circuits, the first of which has an on state in which a coil of the contactor is energized, and an off state. The first circuit switches from the off state to the on state when a power source is electrically connected to the first circuit if an additional signal is also present, and then remains in the on state until the power source is disconnected. The second circuit prevents the additional signal from being received by the first circuit when the auxiliary contact is in a position indicating that one of the main contacts is welded. The third circuit causes the first circuit to be disconnected from the power source when the fourth circuit provides a signal indicating that one of the auxiliary contacts is welded.

21 Claims, 6 Drawing Sheets

SAFETY RELAY CIRCUIT FOR LARGE POWER CONTACTORS

CROSS-REFERENCE TO RELATED APPLICATIONS

1. Field of the Invention

The present invention relates to relay circuits and, in particular, to safety relay control circuits that are employed to monitor the status of power contactors.

2. Background of the Invention

In many industrial and other systems, high levels of power are required by loads, and must be repeatedly switched on and off with respect to the loads. Power contactors are commonly employed to provide this switching function. Although rare, it is occasionally possible that one or more of the contacts within such power contactors, which are normally open, become welded closed due to arcing that occurs during the switching process. Because such welding of one or more contacts precludes those contacts from being switched off, and thus precludes those contacts from being employed to switch off the power to the loads, it is important that welded contacts be identified soon after a welding event occurs so that the welded contacts can be replaced.

In order to identify welded contacts, safety relay circuits can be employed. Referring to FIG. 1, a Prior Art safety relay circuit 100 is shown that is capable of monitoring whether any of three power contacts 102, 104 and 106 have become welded closed. As shown, each of the three power contacts 102, 104 and 106 governs whether a corresponding single-phase of power provided by a respective line 112, 114 and 116 is provided to a high-power, three-phase load 108. The safety relay circuit 100, upon identifying whether any of the three power contacts 102, 104 or 106 is welded closed, provides a signal to an operator (or other controller or control system) indicating the welded state of the power contact(s), typically by preventing the operator from restarting a system 110 of which the three-phase load 108 and the safety relay circuit 100 form a part.

The safety relay circuit 100, which is shown in a ladder diagram format in FIG. 1, operates as follows. As shown, an operator can press an ON button 118 so that a first port 124 of a standard safety relay 120 is coupled to a power (or voltage or current) source 122. In the present embodiment, the standard safety relay 120 is an A-B 440R-ZBL220224 safety relay manufactured by the Allen-Bradley Company of Milwaukee, Wis. In alternate embodiments, the safety relay 120 can be another type of safety relay. In the embodiment shown, the safety relay 120 is configured to apply a voltage to a second port 126 once the voltage source 122 is coupled to the first port 124.

The safety relay circuit 100 further includes a normally-closed auxiliary contact 130 coupled between the second port 126 and a third port 128 of the safety relay 120. Assuming that the auxiliary contact 130 is in fact in its closed position, the third port 128 experiences a voltage change as the voltage is applied by the safety relay 120 to the second port 126. The safety relay 120 is further coupled to ground 123 at a fourth port 132. If each of the above-described events occurs, the safety relay 120 switches from an off state to an on state. Also as shown, the safety relay 120 in this embodiment includes several other ports, including ports 125, 127, 129 and 131, between which are coupled a set of emergency stop switches 133, which allow for the safety relay to be switched to its off state in an emergency. Further, the safety relay circuit 100 is coupled to certain of the lines 114,116 by way of a power transformer 135, one side of which is coupled between the power source 122 and ground 123, and the safety relay circuit further includes one or more protective fuses 137 that can have a variety of current tolerances.

As shown on line 5 of the ladder diagram, the safety relay 120 has fifth and sixth ports 140 and 134, respectively, between which are coupled first and second normally-open contacts 136 and 138, respectively. The fifth port 140 is additionally coupled to the power source 122 while the sixth port 134 is additionally coupled to a first coil 142, which is coupled between the sixth port and the ground 123. In accordance with the ladder diagram, the first and second normally-open contacts 136,138 within the safety relay 120 close when the safety relay switches to its on state, such that the power source 122 is electrically coupled to the first coil 142. The first coil 142, which is thus coupled between the voltage source 122 and ground, consequently conducts and is energized.

When the first coil 142 is energized, several contacts switch from their normal positions to their excited positions. First, each of the power contacts 102–106 switches to its closed position, such that the three single-phases of power associated with the lines 112–116 are provided to the three-phase load 108. Additionally, in accordance with the ladder diagram, the normally-closed auxiliary contact 130 is opened and a normally-open sustaining contact 143 that is coupled in parallel with the ON button 118 is closed. The sustaining contact 143 thus maintains the electrical coupling between the first port 124 and the power source 122 even though the operator releases the ON button 118.

The safety relay 120 is designed to operate so that, as long as the voltage source 122 continues to be coupled to the safety relay 120, the safety relay remains in its on state such that the contacts 136,138 remain closed and the first coil 142 remains conductive, even though the auxiliary contact 130 is opened. That is, the auxiliary contact 130 need only be closed at the time that the first port 124 is coupled to the voltage source 122 in order for the safety relay 120 to enter its on state, and need not remain closed thereafter in order for the safety relay 120 to remain in its on state. In order to deenergize the first coil 142, and consequently to open the power contacts 102–106, open the sustaining contact 143 and close the auxiliary contact 130, the operator presses an OFF button 144. This causes a decoupling of the power source 122 from the first port 124, which causes the safety relay 120 to return to an off state so that both of the contacts 136,138 open.

The safety relay circuit 100 is usually capable of providing an indication to an operator when one or more of the power contacts 102–106 has welded and will not return to an open position. As shown in FIG. 2 (Prior Art), each of the power contacts 102–106 and the auxiliary contact 130 are physically positioned within a single power contactor 146 along with the coil 142. All of the power contacts 102–106 and the auxiliary contact 130 are physically coupled to one another so that, during proper operation, the contacts are all in their normal positions, in their excited positions, or in between their normal and excited positions.

Usually, when the first coil 142 becomes conductive or energized, all of the contacts 102–106 and 130 move to their excited positions. Also, the power contactor 146 is spring-loaded such that, when the first coil 142 becomes non-conductive or deenergized, the contacts 102–106 and 130 usually all return to their normal positions. However, if any one or more of the power contacts 102–106 become welded in their respective closed positions, the spring-loading within the power contactor 146 is insufficient to cause the contacts to return to their normal positions. That is, one of the power contacts 102–106 becomes locked in its excited, closed position, while the auxiliary contact 130 becomes locked in its excited, open position.

Because welding of any of the power contacts 102–106 causes the auxiliary contact 130 to become locked in its open position, the safety relay circuit 100 is able to provide the operator with an indication that a welding event has occurred. Specifically, because the auxiliary contact 130 is locked in its open position, the safety relay 120 does not experience a voltage change at its third port 128 when the ON button 118 is pressed and the power source 122 is coupled to the first port 124. Consequently, once the system 110 is shut down due to the pressing of the OFF button 144 and the deenergizing of the coil 142, the operator is later not able to restart the system by pressing the ON button 118.

Although the safety relay circuit 100 as implemented in conjunction with the power contactor 146 is capable of providing an indication of when one or more of the power contacts 102–106 have experienced a welding event, the safety relay circuit and power contactor 146 could be improved in two respects. First, as shown in FIG. 2, the physical layout of the power contactor 146 can be such that the distances between the auxiliary contact 130 and each of the respective power contacts 102–106 are unequal and/or significant. Given such a physical layout, it is possible that under certain physical stresses the power contactor 146 could be twisted or bent in such a manner as to eliminate or hinder the physical coupling of one or more of the physical contacts 102–106 with the auxiliary contact 130.

In particular, the physical coupling between the power contact 102, which is the power contact farthest from the auxiliary contact 130, and the remaining contacts 104,106, 130 could be significantly undermined. If this happened, and the power contact 102 was welded in its closed position, then it would be possible that the remaining power contacts 104,106 would return to their normal, open positions and the auxiliary contact 130 would follow those remaining power contacts and return to its normal, closed position. In such a circumstance, the safety relay circuit 100 would not be able to provide an indication that a welding event had occurred with respect to the power contact 102, since the auxiliary contact 130 would be in its normal, closed position when the ON button 118 was pressed.

Second, although the safety relay circuit 100 is normally capable of providing, in the absence of the above-described physical damage to the power contactor 146, an indication that a welding event has occurred when any of the power contacts 102–106 have welded, the safety relay circuit 100 is not capable of providing such an indication in the circumstance where the auxiliary contact 130 itself has welded in its closed position. Despite the physical coupling of the auxiliary contact 130 to the power contacts 102–106, the physical size and structural strength of the power contacts are significantly greater than that of the auxiliary contact, such that the welding of the auxiliary contact 130 in its closed position does not physically restrict the motion of the power contacts. Rather, when the auxiliary contact 130 is welded, the physical connection between the auxiliary contact and the power contacts 102–106 will tend to break or diminish as the power contacts attempt to move to their closed positions.

Consequently, if the auxiliary contact 130 is welded, the pressing of the ON button 118 can continue to cause the closing of the power contacts 102–106 and start the system 110, as if nothing had happened. At the same time, since the auxiliary contact 130 cannot open upon the welding of any of the power contacts 102–106, the safety relay circuit 100 also continues to allow starting of the system 110 even when one or more of the power contacts are additionally welded shut.

For these reasons, a need exists for an improved safety relay circuit. In particular, a need exists for a safety relay circuit that will successfully indicate the welding of a power contact of a power contactor even when the power contactor was significantly physically bent or twisted. Additionally, a need exists for a safety relay circuit that will not only indicate when a power contact has been welded, but also will indicate when a welding problem has occurred with respect to an auxiliary contact employed by the safety relay circuit in monitoring the power contacts.

BRIEF SUMMARY OF THE INVENTION

The present inventors have discovered a safety relay circuit that is capable of monitoring whether one or more main contacts of a contactor have welded, and also capable of determining whether one or more auxiliary contacts have welded. In one embodiment, the safety relay circuit includes four circuits, the first of which has an on state in which a coil of the contactor is energized, and an off state in which the coil is deenergized. The first circuit switches from the off state to the on state when a first signal (such as power from a power source) is provided to the first circuit if an additional signal is also present, and then remains in the on state until the first signal is discontinued. The second circuit prevents the additional signal from being received by the first circuit when the auxiliary contact is in a position indicating that one of the main contacts is welded. The third circuit causes the first signal to be discontinued when the fourth circuit provides a further signal indicating that one of the auxiliary contacts is welded. The further signal is provided when both the coil is energized and yet the auxiliary contact remains in its normal position. A time delay feature is present in the third circuit so that the further signal indicating that the auxiliary contact has welded must be provided for a certain time before the third circuit causes the first signal to be discontinued.

In particular, the present invention relates to an apparatus for monitoring a first main contact within a first contactor, where the first contactor further includes a first auxiliary contact and a first primary coil, and where energizing of the first primary coil by way of a power source causes each of the first main contact and the first auxiliary contact to switch. The apparatus includes a trigger coupled to a power terminal capable of being coupled to the power source, and a first circuit that is electrically connected to the power terminal upon actuation of the trigger and that has an on state and an off state. The first circuit switches from the off state to the on state when the power source is electrically connected to the first circuit by way of the power terminal if an additional signal is received by the first circuit at that time. Also, the first circuit remains in the on state once it has entered that state until the power source is disconnected from the first circuit, and the first circuit causes the primary coil to be energized when the first circuit is in the on state. The apparatus additionally includes a second circuit coupled to the first circuit and to the auxiliary contact, where the second circuit prevents the additional signal from being received by the first circuit when the auxiliary contact is in a first position, and a third circuit that causes the first circuit to be electrically disconnected from the power terminal when the third circuit is in a first state, and further causes the first circuit to be electrically connected to the power terminal while the third circuit is in a second state. The apparatus further includes a fourth circuit coupled to the third circuit and including portions of the first and second circuits. The fourth circuit causes the third circuit to enter the first state when at least one of the first circuit enters the off state such that the primary coil becomes and remains deenergized for a first period of time, and the first auxiliary contact remains in a second position for the first period of time while the first circuit is in the on state.

The present invention further relates to an apparatus for monitoring a main contact within a power contactor, where the power contactor further includes an auxiliary contact and a coil. The apparatus includes means for controlling an energizing of the coil, where the coil becomes energized only when the means for controlling receives both a first signal and a second signal, and where the coil remains energized as long as the means for controlling continues to receive the first signal. The apparatus further includes means for determining whether the second signal is provided to the means for controlling based upon a status of the auxiliary contact. The apparatus additionally includes means for preventing the first signal from continuing to be provided to the means for controlling when it is determined that, despite the energizing of the coil, the status of the auxiliary contact has not changed.

The present invention additionally relates to, in a system for monitoring a main contact of a contactor that includes a primary coil and a first auxiliary contact, a method of monitoring the first auxiliary contact employed in monitoring the main contact. The method includes providing a first signal to a first circuit of the system, providing a second signal from a second circuit of the system to the first circuit if the second circuit determines that the auxiliary contact is in a first position, and switching the first circuit from an off state to an on state upon receiving the first and second signals at the first circuit, where in response the primary coil is energized. The method further includes providing a third signal to a third circuit of the system when, after the energizing of the primary coil, the auxiliary contact remains in the first position, and causing the first signal to no longer be provided to the first circuit in response to the third signal so that the first circuit returns to the off state and the primary coil is deenergized.

The present invention further relates to a power contactor that includes a coil having first and second ends and first and second sides connecting the first and second ends, a first auxiliary contact supported by the power contactor along the first side of the coil, and a second auxiliary contact supported by the power contactor along the second side of the coil. The power contactor further includes a first power contact supported by the power contactor proximate the first end of the coil nearer to the first auxiliary contact than to the second auxiliary contact, and a second power contact supported by the power contactor proximate the first end of the coil nearer to the second auxiliary contact than to the first auxiliary contact. Each of the auxiliary contacts and power contacts are configured to switch from their respective normal statuses to their respective alternate statuses upon energizing of the coil.

DETAILED DESCRIPTION OF THE INVENTION

Figure 1:
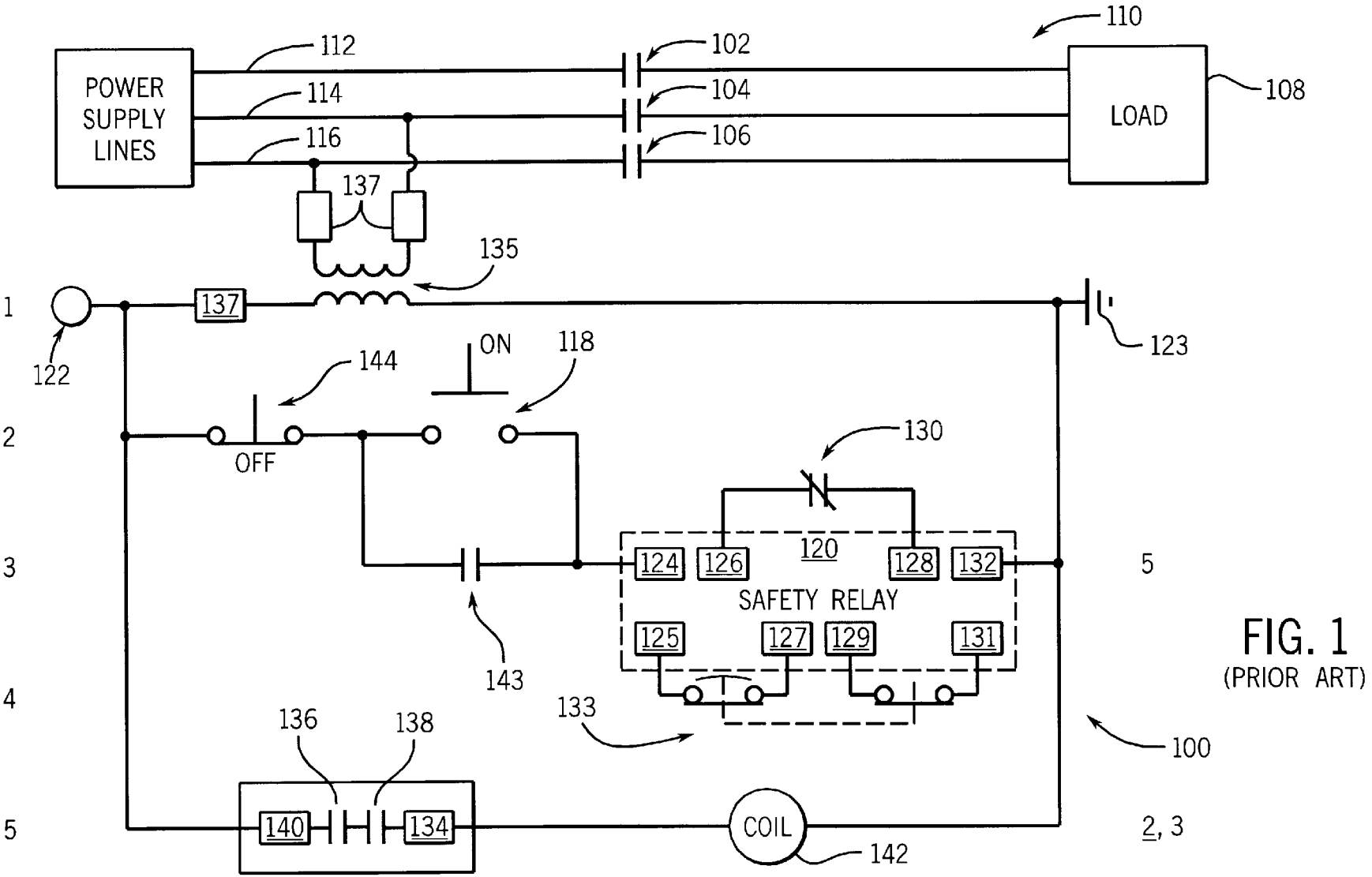
FIG. 1 (PRIOR ART)
FIG. 1 is a ladder diagram showing a Prior Art safety relay circuit that operates to monitor power contacts that determine whether power is provided to a load in a system.
Figure 3:
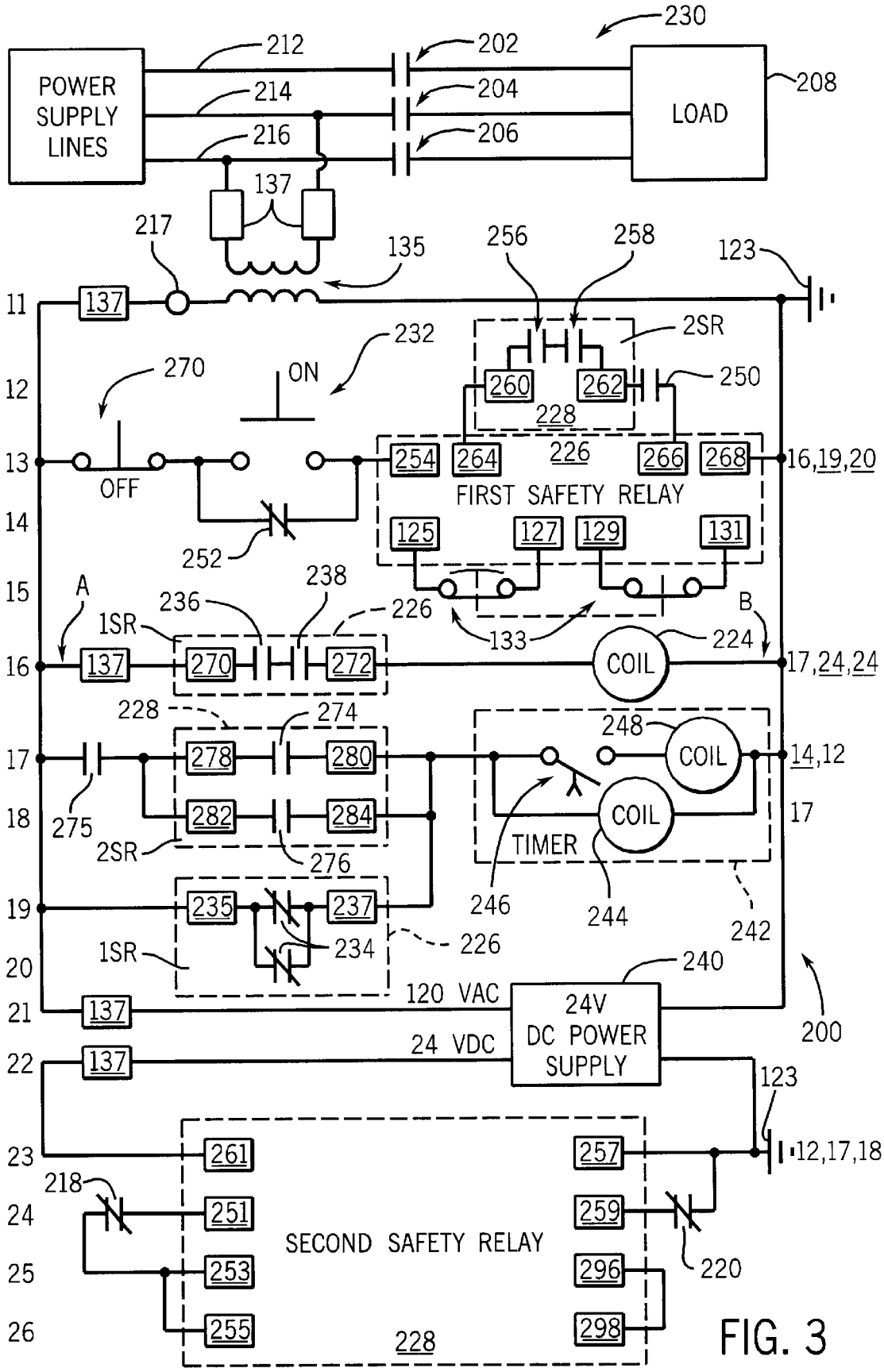
FIG. 3 is a ladder diagram showing a set of power contacts and a pair of mirror auxiliary contacts, and a safety relay circuit including circuitry allowing for the detection of a welded power contact or auxiliary contact, in accordance with one embodiment of the present invention.

Referring to FIG. 3, a safety relay circuit 200 is shown that is capable of monitoring whether any of three power contacts 202, 204 and 206 have become welded closed. As shown, each of the three power contacts 202, 204 and 206 governs whether a corresponding single-phase of power provided by a respective line 212, 214 and 216 is provided to a high-power, three-phase load 208. The safety relay circuit 200, upon identifying whether any of the three power contacts 202, 204 or 206 is welded closed, provides an indication to an operator (or other controller or control system) that a welding event has occurred. The safety relay circuit 200 is more reliable than the safety relay circuit 100 of FIG. 1 because the safety relay circuit 200 includes first and second mirror auxiliary contacts 218 and 220, respectively. The mirror auxiliary contacts 218,220 make the safety relay circuit 200 more reliable in identifying whether one or more of the power contacts 202, 204 and/or 206 are welded. Further, in the present embodiment, as discussed further below, both of the mirror auxiliary contacts 218, 220 must be in their excited (open) position in order for the system to be restarted after the system has been shut down. In this way, the safety relay circuit 200 is able to provide an indication of whether one of the mirror auxiliary contacts 218,220 has been welded. Any of these indications that one or more of the contacts are welded can also specifically be provided to an operator by lighting up a corresponding LED or pilot light, or in any of a variety of other ways (e.g., by sounding an alarm).

Figure 2:
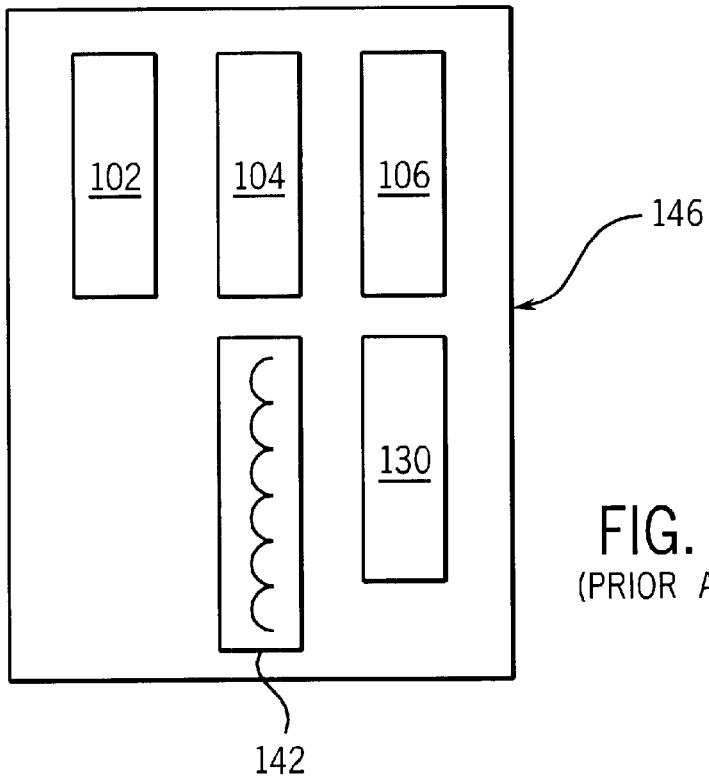
FIG. 2 (PRIOR ART)
FIG. 2 is a schematic diagram of a Prior Art power contactor that includes the power contacts of FIG. 1.
Figure 4:
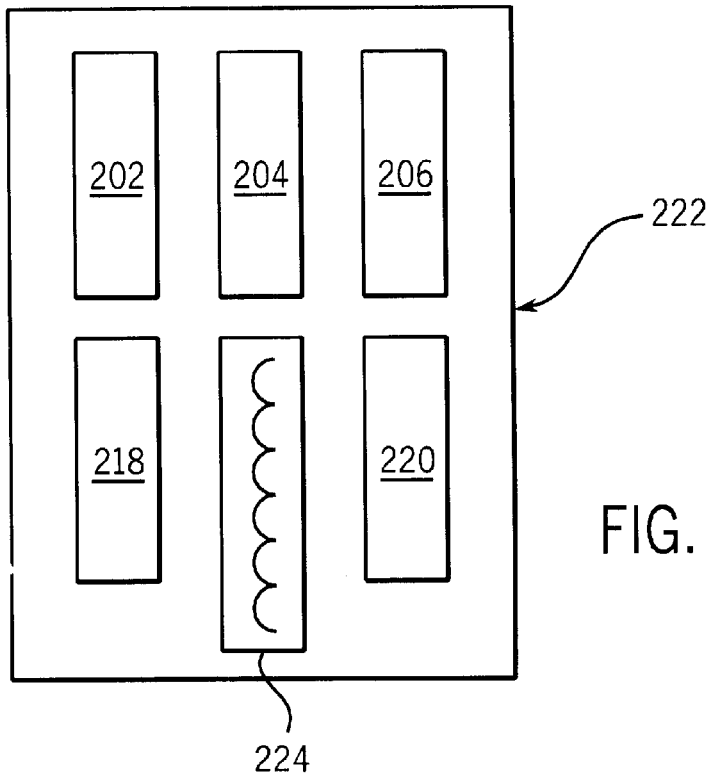
FIG. 4 is a schematic diagram of a power contactor including the mirror auxiliary contacts of FIG. 3.

Referring also to FIG. 4, the power contacts 202, 204 and 206 and the mirror auxiliary contacts 218, 220 are positioned within a power contactor 222. In contrast to the power contactor 146 of FIG. 2, the power contactor 222 is configured so that the first and second mirror auxiliary contacts 218, 220 are positioned on opposite sides of a primary or main (driving) coil 224, such that the first auxiliary contact 218 is closer to the first and second power contacts 202, 204 while the second auxiliary contact 220 is closer to the third and second power contacts 206, 204. All of the power contacts 202, 204 and 206 and the mirror auxiliary contacts 218,220 are physically coupled to one another. In the present embodiment, the power contacts 202, 204 and 206 are normally-open while the mirror auxiliary contacts 218,220 are normally-closed. In order to start a system 230 including the load 208 and the safety relay circuit 200, an operator (or other controller or control system) caused the primary coil 224 to become energized, which in turn causes the power contacts 202–206 to close and consequently causes power to be provided to the load.

Because respective auxiliary contacts 218,220 are positioned close to each of the power contacts, physical bending or twisting of the power contactor 222 is much less likely to result in a physical disconnection of the auxiliary contacts from the power contacts as can occur in the power contactor 146. In particular, even if there is physical bending of the power contactor 222, the welding of the first power contact 202 is still likely to result in the opening of the first auxiliary contact 218 even if it does not result in the opening of the second auxiliary contact 220, and the welding of the third power contact 206 is still likely to result in the opening of the second auxiliary contact 220 even if it does not result in the opening of the first power contact 202. If the second power contact 204, which is positioned between the first and third power contacts 202 and 206, welds, it is likely that at least one if not both of the auxiliary contacts 218, 220 will open. Therefore, because of the physical layout of the power contactor 222 with its pair of mirror auxiliary contacts 218, 220, a welding event of any of the power contacts 202, 204 and/or 206 is highly likely to cause at least one of the mirror auxiliary contacts to open, which (as discussed below) is sufficient to cause the safety relay circuit 200 to provide an indication of the welding event.

Referring still to FIG. 3, in the present embodiment, the safety relay circuit 200, which is shown in ladder diagram format, employs a first safety relay 226 and a second safety relay 228. The two safety relays 226, 228 allow the safety relay circuit 200 not only to provide an indication that a welding event has occurred with respect to one or more of the power contacts 202, 204 and 206, but also provide an indication when the safety relay circuit itself is malfunctioning due to the occurrence of a welding event with respect one or both of the auxiliary contacts 218, 220. As shown, the safety relay 226 in the present embodiment is a standard A-B 440R-C23018 safety relay manufactured by the Allen-Bradley Company of Milwaukee, Wis., and the safety relay 228 in the present embodiment is a standard A-B 440R-ZBL220224 safety relay also manufactured by the Allen-Bradley Company.

The safety relay circuit 200 operates as follows. Under normal operating circumstances, none of the power contacts 202–206 or the auxiliary contacts 218,220 is welded closed. Prior to when an operator (or other controller or control system) decides to start the system 230, the first safety relay 226 is in an off state such that first and second normally-open contacts 236, 238 within the first safety relay are open. Consequently, as shown at line 16 of the ladder diagram, the primary coil 224 is decoupled from a power source 217 formed as the output of the transformer 135, and therefore is not conducting at this time. In the present embodiment, the power source 217 provides 120 Volts (AC) power. (It is to be understood that the power source 217 can be provided by way of other components other than the transformer 135 depending upon the embodiment)

Because the primary coil 224 is not energized, each of the power contacts 202–206 and the auxiliary contacts 218,220 are in their normal states. That is, the power contacts 202–206 are open, while the auxiliary contacts 218,220 are closed. Also when the first safety relay 226 is in the off state, two normally-closed contacts 234 at lines 19 and 20 of the ladder diagram are closed. The contacts 234 are coupled in parallel between two ports 235,237 of the first safety relay 226, which respectively are coupled to the power source 217 and to a timer circuit 242. Because the contacts 234 are closed, the power source 217 is electrically coupled across the timer circuit 242, which includes a first coil 244, a time-delayed switch 246, and a second coil 248. The timer circuit 242 operates such that, when the power source 217 is electrically connected to the timer circuit, the first coil 244 immediately conducts. Then, upon the first coil 244 conducting for a short period of time, such as 0.2 (or 0.15) seconds, the switch 246 closes, and the third coil 248 conducts.

In accordance with the ladder diagram, the third coil 248 governs a normally-open contact 250 on line 12 of the ladder diagram, and also a normally-closed contact 252 on line 14 of the ladder diagram. The normally-closed contact 252 on line 14 is coupled between the power source 217 and a first terminal or port 254 of the first safety relay 226, while the normally open contact 250 is coupled between second and third ports 264 and 266, respectively, of the first safety relay. As discussed further below, decoupling of the power source 217 from the first port 254 causes the first safety relay 226 to be in its off state, while decoupling of ports 264 and 266 from one another precludes the first safety relay 226 from being switched to its on state. Consequently, the energizing of the coil 248 and consequent opening of the contact 252 further guarantees that the first safety relay 226 is in its off state and remains in that state. The first safety relay 226 is coupled to the ground 123 at a fourth port 268.

In the absence of a welding event, the safety relay circuit 200 allows an operator (or controller or other control system) to turn on the system 230 such that power is communicated to the load 208, as follows. Specifically, upon the pressing of an ON button 232 coupled in parallel with the contact 252 between the power source 217 and the first port 254 of the first safety relay 226, the power source 217 is coupled to the first port 254. Upon receiving power at the first port 254, the first safety relay 226 then applies a voltage to the second port 264. Also, in the absence of a welding event of the power contacts 202–206, both of the mirror auxiliary contacts 218, 220 are in their normal closed, positions. The first auxiliary contact 218 is coupled between a port 251 and a parallel combination of two ports 253,255 of the second safety relay 228, while the second auxiliary contact 220 is coupled between ports 257 and 259 of the second safety relay. The second safety relay 228 is coupled at an additional port 261 to a power supply 240, which itself receives power from the power source 217, and in the present embodiment provides 24 Volt (DC) power. (Depending upon the embodiment, an alternate type of power supply can be provided, and/or the power source 217 can be used to directly power both the first and second safety relays 226,228.) The second safety relay 228 is coupled to the ground 123 at the power 257.

Because the first and second auxiliary contacts 218,220 are in their closed positions, the second safety relay 228 causes first and second normally-open contacts 256, 258 of the second safety relay to respectively close. As shown at line 12 in the ladder diagram, the contacts 256,258 are coupled in series between respective ports 260 and 262 of the second safety relay 228. Further, the series combination of the ports 260 and 262 and the contacts 256 and 258 are further coupled in series with the normally-open contact 250 between the second and third ports 264,266 of the first safety relay 226. Because the contact 250 is also closed because the second coil 248 is still conducting, the second and third ports 264,266 of the first safety relay 226 are connected to one another. Consequently, because the first safety relay 226 applies a voltage to the second port 264 upon being coupled to the power source 217 at the first port 254, a voltage signal is received at the third port 266 of the first safety relay.

The first safety relay 226 is designed to enter its on state when the first port 254 is coupled to the power source 217 at a time when the second and third ports 260,262 are coupled to one another. Once the first safety relay 226 has entered its on state, it remains in the on state even though the connection between the second and third ports 264,266 is broken so long as power continues to be provided to the first port 254. Consequently, the above pressing of the ON button 232 in combination with the closed status of the contacts 256, 258 and 250 causes the first safety relay 226 to enter the on state.

Upon reaching its on-state, the normally-open contacts 236, 238 of the first safety relay 226, which are shown at line 16 in the ladder diagram, become closed. The contacts 236, 238 are coupled in series between ports 270 and 272 of the first safety relay 226, which in turn are respectively coupled to the power source 217 and the first coil 224. Consequently, when the first safety relay 226 switches to the on state, the power source 217 is coupled to the primary coil 224, which is also coupled to the ground 123 and consequently conducts current. Upon conduction by the primary coil 224, each of the power contacts 202–206 closes and thus the three phases of power 212–216 are provided to the load 208. Also, each of the mirror auxiliary contacts 218,220 switch to their excited, open states. Further, a normally-open contact 275 (discussed further below) is closed.

Additionally because the first safety relay 226 switches on, the normally-closed contacts 234 become open and consequently the first and second coils 244,248 of the timer circuit 242 are deprived of power. Because the second coil 248 is deenergized, the contact 252 returns to its normal, closed state. The closing of the contact 252 allows the coupling of the power source 217 and the first safety relay 226 to be maintained so that the first safety relay remains in the on state. Also because the second coil 248 is deenergized, the contact 250 returns to its normal, open state such that the second and third ports 264,266 are decoupled. This does not affect the state of the first safety relay 226 since that relay has already switched to its on state.

Further because the first and second auxiliary contacts 218 and 220 respectively become opened, the second safety relay circuit 228 in response causes third and fourth normally-open contacts 274 and 276 of the second safety relay to open, respectively. As shown, the third normally-open contact 274 is coupled between ports 278 and 280 of the second safety relay 228, the fourth normally-open contact 276 is coupled between ports 282 and 284 of the second safety relay, the ports 280 and 284 are both coupled to the timer circuit 242, and the ports 278 and 282 are coupled to the contact 275, which in turn is coupled to the power source 217. Thus, the contact 275 is coupled in series with the parallel combination of the third and fourth normally-open contacts 274,276 of the second safety relay 228, between the power source 217 and the timer circuit 242.

Additionally in accordance with the ladder diagram, the first and second normally-open contacts 256, 258 shown at line 12 of the ladder diagram switch open. This does not affect the status of the first safety relay 226 since that relay has already switched to its on state and, in any event, the contact 250 in series with the contacts 256,258 is also open.

The safety relay circuit 200 further includes an OFF button 270 coupled between the first port 254 and the power source 217, in series between the parallel combination of the ON button 232 and the contact 252. Under normal operation, the system 230 is shut off such that the power contacts 202–206 are opened when the operator presses the OFF button 270, since this causes the power source 217 to be disconnected from the first port 254 of the first relay 226. The disconnection of the power source 217 from the first port 254 in turn causes the first safety relay 226 to return to its off-state, which causes the normally-open contacts 236, 238 to open and consequently the power source 217 to be decoupled from the first coil 224.

The safety relay circuit 200 is capable of providing an indication to an operator when any one or more of the power contacts 202–206 is welded shut, as follows. If one of the power contacts 202–206 becomes welded, that power contact does not open upon the deenergizing of the primary coil 224 in response to the pressing of the OFF button 270. Consequently, at least one and normally both of the mirror auxiliary contacts 218,220 remain open despite the pressing of the OFF button 270. Consequently, later, when the ON button 232 is pressed, one or both of the contacts 256, 258 remain open such that the second and third ports 264 and 266 are decoupled and the third port 266 in particular does not receive a signal as required for the first safety relay 226 to switch to its on state. Consequently, even though the ON button 232 is pressed, the primary coil 224 is not energized and so the system 230 does not start, thereby providing the operator with an indication of a system malfunction.

Further, the safety relay circuit 200 provides an indication to the operator of whether one or both of the mirror auxiliary contacts 218, 220 has become welded. If one or both of the mirror auxiliary contacts 218, 220 become welded shut, then those auxiliary contacts will not open in response to the switching on of the first safety relay 226 and the energizing of the primary coil 224 in response to the pressing of the ON button 232. As discussed, upon the switching on of the first safety relay 226, the normally-closed contacts 234 shown at lines 19 and 20 of the ladder diagram become open and consequently the second and third coils 244, 248 shut off. However, also in response to the switching on of the first safety relay 226 and the energizing of the primary coil 224, the contact 275 at line 17 of the ladder diagram switches to its alternate, closed position. Because one or both of the third and fourth normally-open contacts 274,276 of the second safety relay circuit 228 also are closed because one or both of the auxiliary contacts 218,220 are welded closed, the timer circuit 242 is again coupled to the power source 217.

When the power source 217 is coupled to the timer circuit 242, the first coil 244 is immediately energized. Then, once the switch 246 has closed after the passing of the time delay period, the second coil 248 is also energized, thus causing the contact 252 shown at line 14 of the ladder diagram to open. Thus, if one or both of the mirror auxiliary contact 218, 220 is welded shut, and remains shut after the switching on of the first safety relay 226 for at least the period of time associated with the closing of the switch 246, the first safety relay 226 returns to the off state and thus the system 230 is switched off. Therefore, despite the repeated pressing of the ON button 232 by an operator, the system 230 will therefore will not start. In this way, the safety relay circuit 200 provides an indication of when one or both of the mirror auxiliary contacts 218, 220 has welded and prevents operation of the system 230 until such time as the welded mirror auxiliary contact is repaired.

Figure 5A:
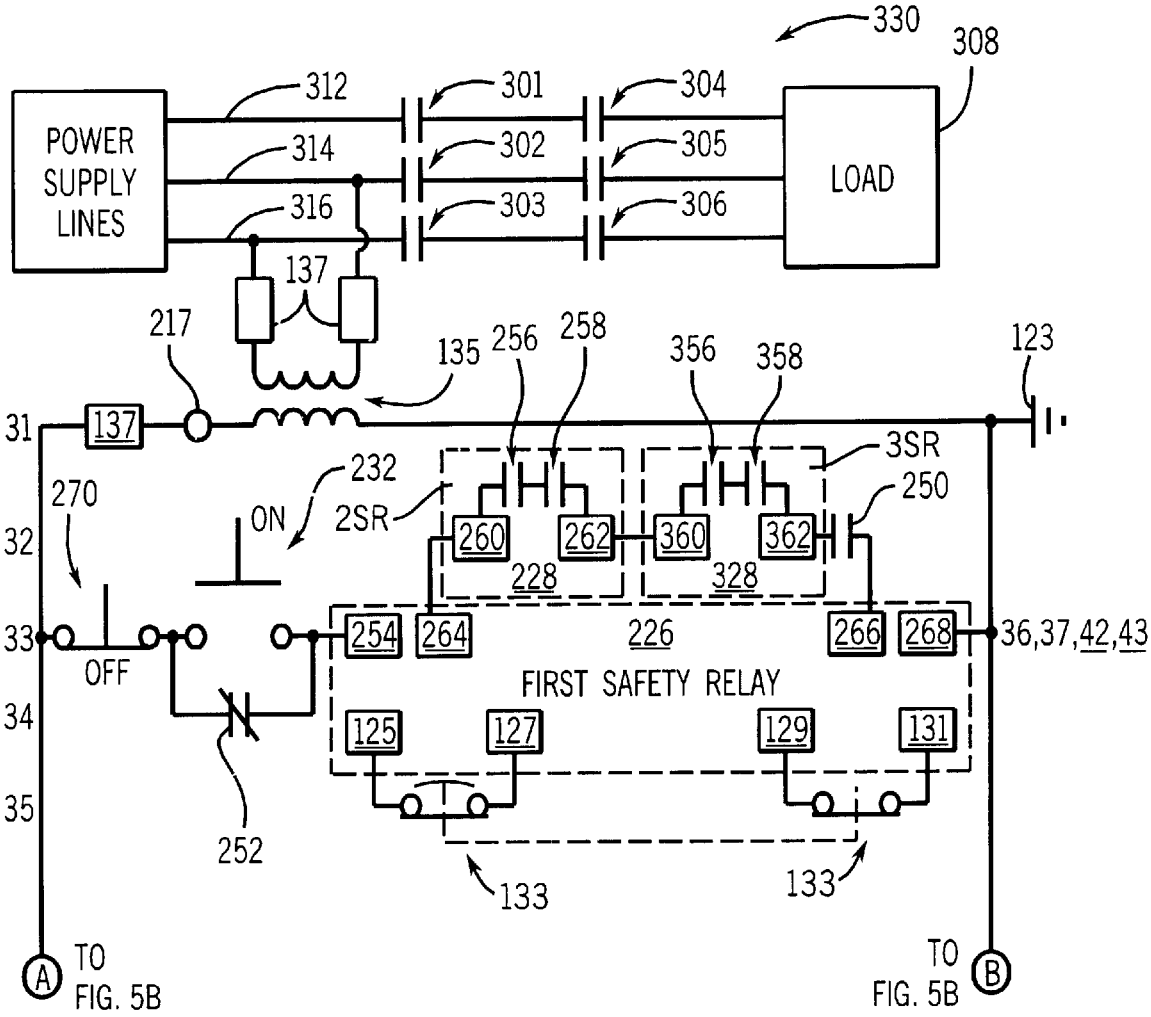
FIGS. 5A&B are a ladder diagram showing two sets of power contacts and two pairs of mirror auxiliary contacts, and a safety relay circuit including circuitry allowing for the detection of a welded power contact or auxiliary circuit, in accordance with another embodiment of the present invention.

Turning to FIGS. 5A&B, an alternate embodiment of a safety circuit 300 is shown that is capable of operating in conjunction with an alternate type of system 330 that provides three phases of power from three respective lines 312, 314 and 316 to a load 308 by way of three pairs of power contacts 301 and 304, 302 and 305, and 303 and 306, respectively. The system 330 can be implemented so that the first power contact of each pair of power contacts is relatively protected from welding. This is accomplished by always closing the first power contacts 301–303 of the respective pairs of contacts first whenever the system 330 is being switched on. In this way, the first power contacts 301–303 of each pair of contacts are largely or entirely shielded from the arcing that occurs when power is switched on to the load 308.

The first power contacts 301–303 can be separately switched from the second power contacts 304–306 because the two sets of contacts are in separate power contactors having separate driving coils. That is, the first of the power contacts in each of the pairs, namely the power contacts 301–303, are housed in a first power contactor such as the power contactor 222, which also includes the primary coil 224 and the first and second mirror auxiliary contacts 218,220. The second of the power contacts in each of the pairs, namely the power contacts 304–306, are housed in a second power contactor such as the power contactor 222, which also includes a secondary coil 324 and third and fourth mirror auxiliary contacts 318,320.

The safety relay circuit 300 of FIGS. 5A&B, which is shown in ladder diagram format, employs many of the same components as are employed by the safety relay circuit 200 shown in FIG. 3. In particular, the same OFF button 270 is coupled in series with the same parallel combination of the ON button 232 and the contact 252, which in turn is coupled to the first port 254 of the first safety relay 226. However, because there are two sets of mirror auxiliary contacts, namely, the first and second mirror auxiliary contacts 218, 220 and additionally the third and fourth mirror auxiliary contacts 318, 320, both the second safety relay 228 and a third safety relay 328 are employed. The first and second auxiliary contacts 218,220 continue to be coupled to ports 251,253,255,257 and 259 of the second safety relay 228 as in FIG. 3, while the third and fourth auxiliary contacts 318,320 are coupled to corresponding ports 351,353,355, 357 and 359 of the third safety relay 328. The third safety relay 328 additionally includes port 361 similar to port 261 of the second safety relay 228. The third safety relay 328 can be of the same type (e.g., A-B 440R-ZBL220224) as the second safety relay 228.

As shown, there are coupled in series between the ports 264 and 266 of the first safety relay 226, in addition to the contact 250, contacts corresponding to each of the first, second, third and fourth mirror auxiliary contacts 218, 220, 318 and 320. Specifically, the port 264 of the first safety relay 226 is coupled to the port 260 of the second safety relay 228, which in turn is coupled to the port 262 of the second safety relay by way of the normally-open contacts 256, 258. The port 262 is in turn coupled to a port 360 of the third safety relay 328, which in turn is coupled to a port 362 of the third safety relay by way of normally-open contacts 356, 358. The port 362 of the third safety relay 328 is coupled in turn to the contact 250, which is then coupled to the port 266 of the first safety relay 226.

The normally-open contacts 256, 258, 356 and 358 respectively are closed when the respective auxiliary contacts 218, 220, 318 and 320 are closed, and the respective contacts are opened when the respective auxiliary contacts are opened. Consequently, whenever any one of the power contacts 301–306 is welded shut, one or more of the auxiliary circuits 218, 220, 318 and 320 are opened, one or more of the contacts 256, 258, 356 and 358 are opened, and thus the first safety relay 226 will not switch to its on state when the ON button 232 is pressed.

The safety relay circuit 300 operates similarly to the safety relay circuit 200 when switching from its off state to its on state. As discussed above, the pressing of the ON button 232 couples the power source 217 to the port 254 of the first safety relay 226. Because the contact 250 is closed (since the second coil 248 is energized), and assuming that each of the contacts 256,258,356 and 358 is closed, which indicates that all of the power contacts 301–306 are opened and not welded, the port 264 of the first safety relay 226 is coupled to the port 266 of that relay and, consequently, the first safety relay switches to its on state. Upon switching on, the first safety relay 226 causes the contacts 236 and 238 to become closed such that the primary coil 224 is energized, causing each of the first power contacts 301–303 to close. The energizing of the first coil 224 further causes an additional contact 339 to close.

The first safety relay 226 includes an additional pair of normally-open contacts 336,338 that are coupled in series between two additional ports 370,372. The port 370 is coupled to the power source 217, while the port 372 is coupled to a further normally-open contact 339 that is in turn coupled to the secondary coil 324, which is then coupled to the ground 123. Upon switching on, the first safety relay 226 causes each of the contacts 336,338 to also close. The contact 339 is further closed upon the energizing of the primary coil 224. In order to delay the energizing of the second set of power contacts 304–306 in relation to the energizing of the first set of power contacts 301, the contact 339 is delayed in opening for a second period of time (e.g., 0.1 seconds). Consequently, the secondary coil 324 is energized slightly later than the primary coil 224, and so the two sets of power contacts 301–303 and 304–306 are closed in a staggered manner such that the brunt of the arcing is borne by the second set of power contacts.

As with respect to the safety relay circuit 200 of FIG. 3, the pressing of the OFF button 270 causes the port 254 to be decoupled from the power source 217, such that the first safety relay 226 switches to its off-state. This in turn precipitates the opening of the contacts 236, 238, 336 and 338, the deenergizing of the primary and secondary coils 224, 324 and the opening of the power contacts 301–306.

The safety relay circuit 300 operates in the same manner as the safety relay circuit 200 in providing an indication to an operator that one or more of the power contacts 301–306 has welded shut. That is, if any of the power contacts 301–303 are welded, one or both of the first and second auxiliary contacts 218, 220 remain open and consequently, when the ON button 232 is pressed, the first safety relay 226 does not switch on because one or both of the contacts 256, 258 remains open. Similarly, if one or more of the power contacts 304–306 is welded shut, one or both of the third and fourth auxiliary contacts 318, 320 remains open and consequently, when the ON button 232 is pressed, the first safety relay 226 cannot be switched on because one or both of the contacts 356, 358 remains open.

The safety relay circuit 300 also operates similarly to the safety relay circuit 200 in terms of the manner in which it operates to provide an indication to the operator that one or more of the mirror auxiliary contacts 218, 220, 318 and 320 have welded shut. The safety relay circuit 300 continues to include the contact 275 that is excited by the primary coil 224. The contact 275 is coupled between the power source 217 and ports 278 and 282 of the second safety relay 228, which continue to be respectively coupled to ports 280 and 284 by way of normally-open contacts 274 and 276, respectively. The ports 280, 284 continue to be coupled to the timer circuit 242. Thus, if one or both of the first and second mirror auxiliary circuits 218, 220 is welded closed, the safety relay circuit 300 precludes the starting of the system in the same manner as that of the safety relay circuit 200.

Similar to the contact 275, the safety relay circuit 300 further includes a normally-open contact 375 that is excited by the secondary coil 324. The contact 375 is coupled between the power source 217 and ports 378 and 382 of the third safety relay 328, which in turn are respectively coupled to ports 380 and 384 of the third safety relay by way of normally-open contacts 374 and 376, respectively. The ports 380 and 384 are both additionally coupled to the timer circuit 242 as well, and the normally-open contacts 374,376 respectively are closed when the auxiliary circuits 318,320 are closed. Consequently, upon the switching on of the first safety relay 226 and energizing of the secondary coil 324, if one or both of the mirror auxiliary contacts 318,320 are welded shut and remain welded shut for the first period of time determined by the switch 246, the contact 252 closes such that the first safety relay 226 returns to its off state and the system 330 is shut down.

Figure 5B:
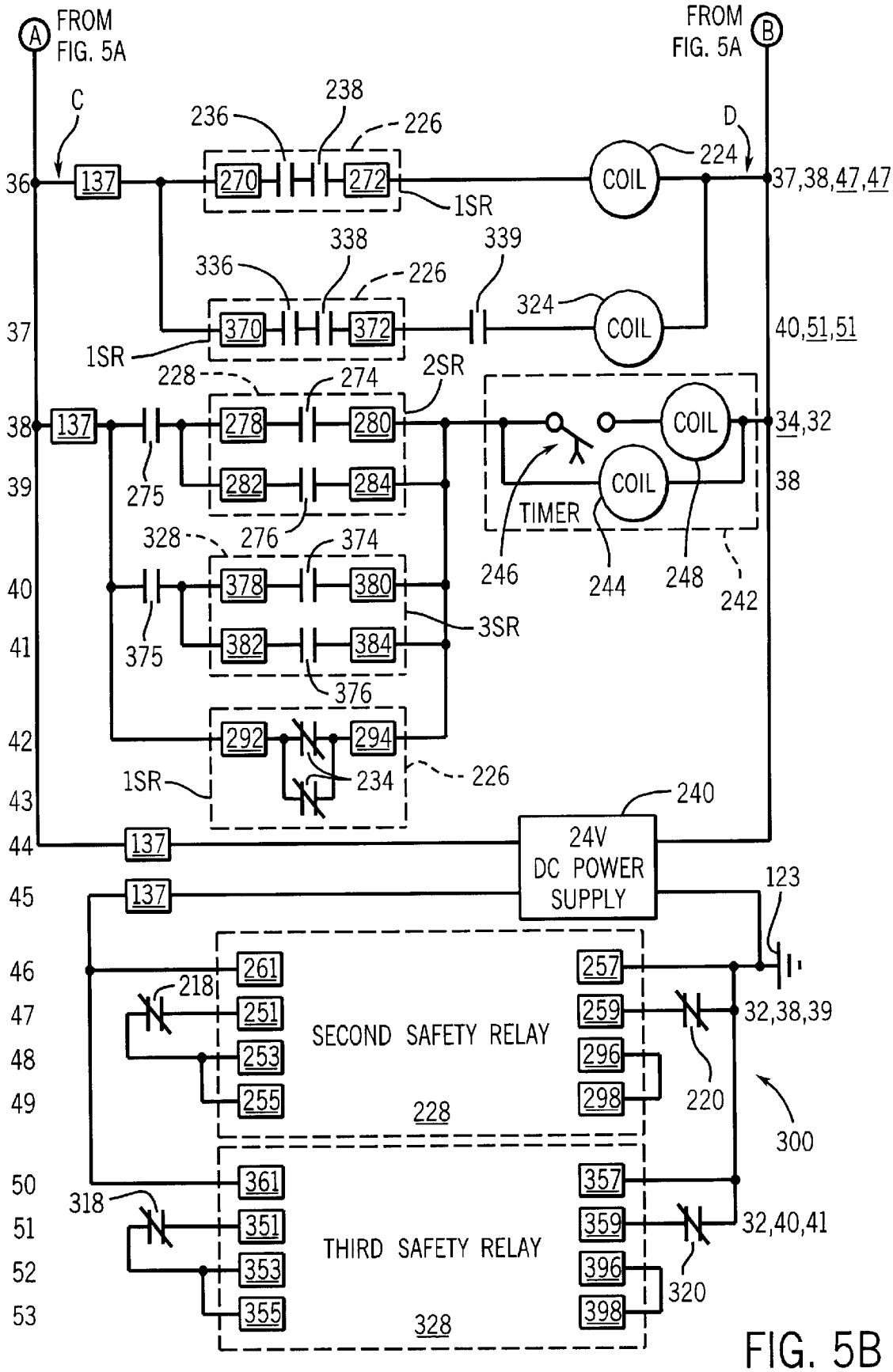
Figure 6:
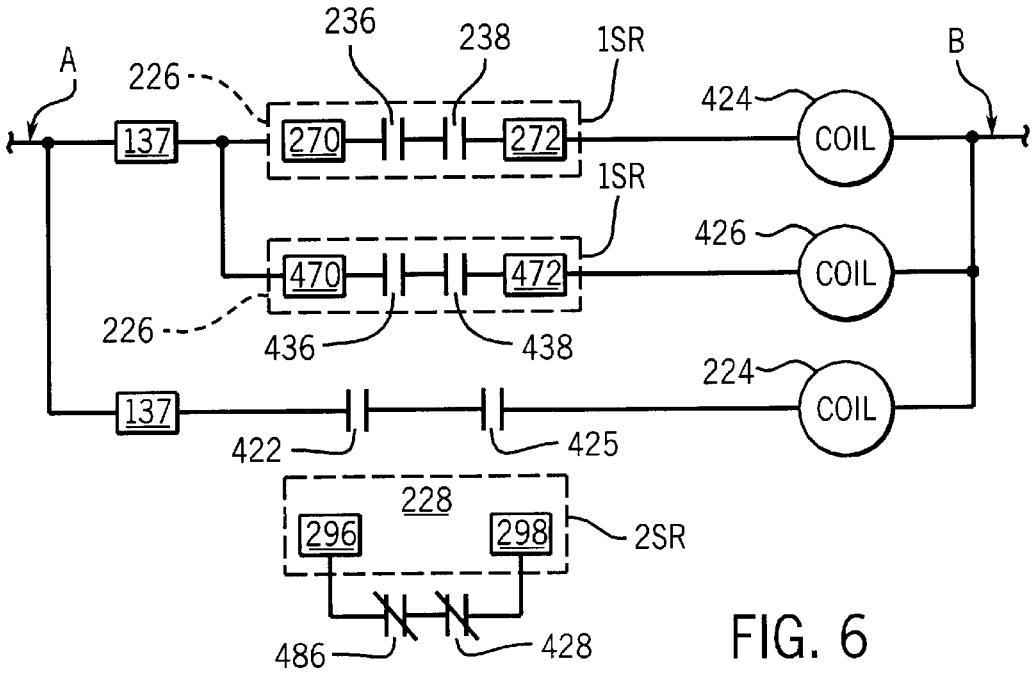
FIGS. 6 and 7 are substitute portions of some of the circuitry of the safety relay circuits shown in the ladder diagrams of FIGS. 3 and 5, respectively.
Figure 7:
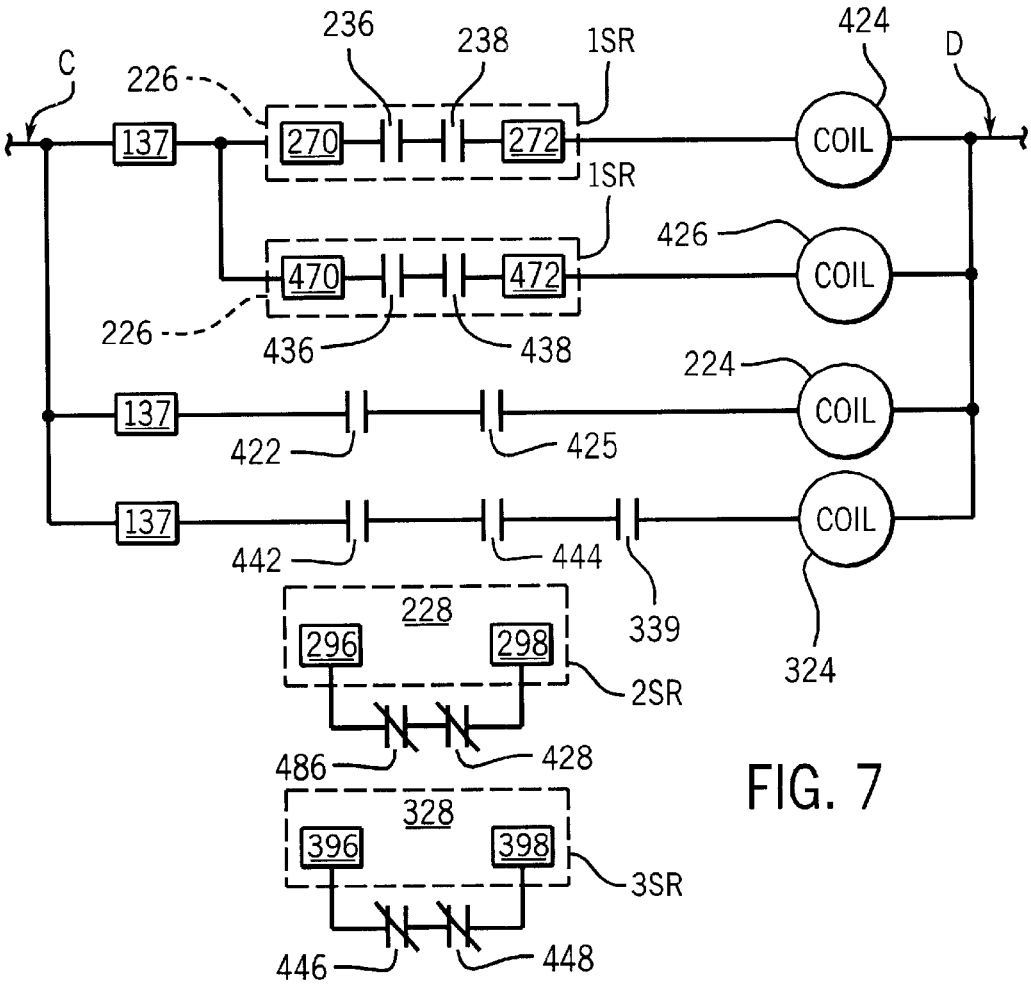

Turning to FIGS. 6 and 7, alternate embodiments are shown concerning the circuitry between points A and B at line 16 of the ladder diagram of FIG. 3 and between points C and D at lines 36 and 37 in the ladder diagram of FIGS. 5A&B, respectively. These alternate embodiments are appropriate for substitution into the safety relay circuits 200, 300 of FIGS. 3 and 5 in circumstances where the power contactor or contactors such as the power contactor 222 have higher coil power requirements (e.g., in rush greater than 500 VA) than can be handled by the first safety relay 226. Particularly referring to FIG. 6, port 270 of the first safety relay 226 continues to be coupled, via point A, to the power source 217, while a first high voltage pickup coil 424 is coupled between port 272 of the first safety relay and point B, where ports 270 and 272 of the first safety relay continue to be coupled by way of the two contacts 236 and 238.

Additionally, coupled in parallel with ports 270,272 and the coil 424 is an additional pair of ports 470,472 of the first safety relay circuit 226 and a second high voltage pickup coil 426. An additional pair of normally-open contacts 436,438 are coupled between the ports 470,472, and the ports 470 and 472 are respectively coupled to point A and the coil 426, which in turn is coupled to point B. As with the contacts 236,238, the contacts 436,438 become closed upon the switching on of the first safety relay 226. Further coupled in parallel with the above components between points A and B is the series combination of two additional normally-open contacts 422 and 425 and the primary coil 224. The respective contacts 422 and 425 are closed upon the energizing of the first and second high voltage pickup coils 424 and 426, respectively. Consequently, the primary coil 224 is only energized once both the first and second high voltage pickup coils 424, 426 have been energized.

The embodiment of FIG. 7 is identical to that of FIG. 6 except insofar as certain additional components have been added to allow for the switching on of both the primary and secondary coils 224, 324. That is, the circuitry coupled between points C and D is identical to that coupled between points A and B except insofar as an additional set of circuit components are coupled in parallel with the other components between points C and D. This additional set of circuit components includes the series combination of additional normally-open contacts 442 and 444, the contact 339 and the secondary coil 324. The contacts 442 and 444 are respectively closed upon the energizing of the first and second high voltage pickup coils 424 and 426, respectively. Thus, the secondary coil 324 only switches on after both of the first and second high voltage pickup coils 424,426 have switched on and then, once the contacts 422 and 425 have closed and the primary coil 224 has been energized, upon the closing of the contact 339.

Further shown in FIG. 6 are ports 296 and 298 of the second safety relay 228. In contrast to the embodiments of FIGS. 3 and 5, these ports are not coupled directly to one another but instead are coupled by the series combination of contacts 486 and 428, which are each normally-closed and are respectively opened in response to the energizing of the first and second high voltage pickup coils 424 and 426, respectively. Likewise, FIG. 7, shows the ports 296 and 298 of the second safety relay 228 to be coupled by the normally-closed contacts 486 and 428, and the ports 396 and 398 of the third safety relay 328 to be coupled by the series combination of normally-closed contacts 446 and 448, which are respectively controlled by the first and second high voltage pickup coils 424 and 426.

In alternate embodiments, a variety of the features of the above-described safety relay circuits 200, 300 and systems 230, 330, generally can be modified from that shown. For example, the first, second and third safety relays 226, 228 and 328 need not be A-B 440R-C23018 and A-B 440R ZBL220224 safety relays, but instead can be any type of safety relay or other first circuit that provides the same functions as described above. In particular, any safety relay or other circuit can be employed in the role of the first safety relay 226 so long as that first circuit switches from an off state to an on state upon receiving a first signal at a particular port if, at that time, another appropriate signal is being received at another port of the circuit. Depending upon the embodiment, the first signal need not be provided from the power source 240, nor need the second signal necessarily be provided by connecting one of the ports of the first circuit to another port of that circuit. However, once switched to its on state, the first circuit should generally remain on as long as the first signal continues to be provided at the first port, regardless of whether the second signal continues to be provided at the second port. Depending upon the embodiment, the first circuit can also be switched on and off in other circumstances, such as the pressing of an emergency stop button.

Depending upon its state, the first circuit employed as the first safety relay should establish electrical connections between pairs of ports, such as the ports 270 and 272 or 370 and 372 as shown in FIGS. 3 and 5, in order that a driving coil can be switched on. In alternate embodiments, the first circuit will simply cause a driving coil to be provided with power. Although pairs of contacts such as contacts 236,238 are shown to be opened and closed by the first safety relay 226 for redundancy, in alternate embodiments, only a single contact need be employed to determine whether power is provided to the driving coil. Further, upon switching to its on state, the first circuit employed as the first safety relay should discontinue any electrical connections (such as that provided by contacts 234) to any third circuit such as the combination of the timing circuit 242 and the contact 252 that otherwise would preclude continued operation of the first circuit in the on state.

Similarly, the second and third safety relays 228, 328 can be replaced by other circuits, so long as those other circuits are able to establish and break electrical connections based upon whether the mirror auxiliary circuits 218, 220, 318 and 320 are closed or open in the same manner as performed by the safety relays 228 and 328. For example, with respect to FIG. 3, an alternate second circuit can be used in place of the second safety relay 228 so long as a connection between two ports of that circuit (paralleling the ports 260 and 262) would be broken if one or both of the mirror auxiliary contacts 218, 220 was open, and be established when both of the mirror auxiliary contacts were closed. Further, in alternate embodiments, the second circuit need only determine whether a particular signal is provided to the first safety relay 226 (or other first circuit) that is required in order to cause switching of the relay from its off state to its on state.

Further, in alternate embodiments, the exact operation of the timer circuit 242 could be varied from that shown. For example, the exact time delay provided by the operation of the switch 246 could be varied from 0.2 (or 0.15) seconds. A different third circuit could be used in place of the timer circuit 242 and the contact 252 that governed whether a power signal from the power source (or a different signal) continued to be provided to the first safety relay 226 (or other first circuit) to maintain operation in the on state. Also, a different circuit could be employed that governed whether or not to actuate the timer circuit 242 in causing the first safety relay 226 to switch from the on state to the off state. That is, while FIG. 3 shows use of the contact 275 in combination with the contacts 234, 274 and 276 of the first and second safety relays 226,228 to control the operation of the timer circuit 242, a variety of other fourth circuits could be employed instead. In any such embodiment, however, the fourth circuit would still cause the timer circuit 242 (or other third circuit) to stop operation of the system 230 if it was determined that any of the auxiliary contacts 218,220 were welded shut.

The present invention is also applicable to the monitoring of a variety of different numbers or configurations of contacts other than those that are shown. For example, the safety relay circuits 200,300 are applicable regardless of whether the contacts being monitored are employed within power contactors or other types of contactors. It is further known by those skilled in the art that circuits employing normally-closed contacts can be readily substituted for circuits employing normally-open contacts, and vice-versa. Likewise, it is known that circuits designed to receive or provide high level signals, can be replaced by circuits designed to receive or provide low-level signals, and vice-versa. Further, it is known that circuits having parallel combinations of components can be readily replaced with circuits having series combinations of components, and vice-versa. Therefore, the present invention is intended to encompass all such variations of the embodiments described above, and is intended to encompass alternate embodiments that provide the capability of indicating when a primary or main contact has welded shut and the capability of indicating when an auxiliary contact has welded or otherwise is malfunctioning.

Additionally, the present invention is intended to encompass embodiments that employ only some of the inventive features described herein. For example, the present invention is intended to encompass a safety circuit that employs a pair of mirror auxiliary contacts rather than employing simply a single auxiliary contact 130. Such a circuit could be created by modifying the circuit of FIG. 1 to include an additionally normally-closed contact corresponding to a second auxiliary contact, in series with the contact 130.

It is specifically intended that the present invention not be limited to the embodiments and illustrations contained herein, but that modified forms of those embodiments including portions of the embodiments and combinations of elements of different embodiments also be included as come within the scope of the following claims.

We claim:

1. An apparatus for monitoring a first main contact within a first contactor, wherein the first contactor further includes a first auxiliary contact and a first primary coil, wherein energizing of the first primary coil by way of a power source causes each of the first main contact and the first auxiliary contact to switch, the apparatus comprising:

a trigger coupled to a power terminal capable of being coupled to the power source;

a first circuit that is electrically connected to the power terminal upon actuation of the trigger and that has an on state and an off state, wherein the first circuit switches from the off state to the on state when the power source is electrically connected to the first circuit by way of the power terminal if an additional signal is received by the first circuit at that time, wherein the first circuit remains in the on state once it has entered that state until the power source is disconnected from the first circuit, and wherein the first circuit causes the primary coil to be energized when the first circuit is in the on state;

a second circuit coupled to the first circuit and to the auxiliary contact, wherein the second circuit prevents the additional signal from being received by the first circuit when the auxiliary contact is in a first position;

a third circuit that causes the first circuit to be electrically disconnected from the power terminal when the third circuit is in a first state, and further causes the first circuit to be electrically connected to the power terminal while the third circuit is in a second state;

a fourth circuit coupled to the third circuit and including portions of the first and second circuits, wherein the fourth circuit causes the third circuit to enter the first state when at least one of:

the first circuit enters the off state such that the primary coil becomes and remains deenergized for a first period of time, and the first auxiliary contact remains in a second position for the first period of time while the first circuit is in the on state.

2. The apparatus of claim 1, wherein the first main contact is normally-open, the first auxiliary contact is normally-closed, and energizing of the primary coil by way of the power source causes the main contact to close and causes the auxiliary contact to open, wherein the first position of the auxiliary contact is its open position and the second position of the auxiliary contact is its closed position, wherein the third circuit enters the first state when the third circuit has been electrically connected to the power source for the first period of time, and returns to the second state when the third circuit is electrically disconnected from the power source; and wherein the fourth circuit includes a first normally-open contact connected in series with a second normally-open contact that is part of the second circuit to form a first series combination, the first series combination being coupled to the third circuit and further coupled to the power terminal, wherein the first normally-open contact closes when the primary coil is energized, and the second normally-open contact closes when the auxiliary contact is closed, so that when the first circuit is in the on state and the primary coil is energized but the auxiliary contact remains closed for the first period of time, the third circuit becomes electrically connected to the power source by way of the first and second normally-open contacts and causes the power source to be electrically disconnected from the first circuit after the first period of time, thus causing the first circuit to switch to the off state and causing the primary coil to be deenergized.

3. The apparatus of claim 2, wherein the first circuit includes first, second, third, fourth, fifth, sixth and seventh ports, wherein the first port is coupled to the trigger, wherein the fourth and fifth ports are coupled to one another by a third normally-open contact, wherein the fourth port is coupled to the power terminal and the primary coil is coupled to the fifth port, wherein the third normally-open contact closes when the first circuit enters the on state so that the primary coil is energized, wherein the sixth and seventh ports are coupled to one another by a first normally-closed contact, wherein the sixth port is coupled to the power terminal and the seventh port is coupled to the third circuit, wherein the sixth and seventh ports and the first normally-closed contact are further included within the fourth circuit, and wherein the first normally-closed contact is opened when the first circuit is in the on state and otherwise is closed so that the third circuit is connected to the power terminal.

4. The apparatus of claim 3, wherein the second circuit includes first, second, third, fourth, fifth and sixth terminals, wherein the auxiliary contact is coupled between the first and second terminals, wherein the third and fourth terminals are coupled to one another by way of a fourth normally-open contact, wherein the third terminal is coupled to the second port and the fourth terminal is coupled to the third port, wherein the fourth normally-open contact is closed when the first auxiliary contact is closed so that the additional signal can be received by the third port, wherein the fifth and sixth terminals are coupled to one another by way of the second normally-open contact, wherein the fifth terminal is coupled to the first normally-open contact, wherein the sixth terminal is coupled to the third circuit, and wherein the fifth and sixth terminals and the second normally-open contact are included within both the second and fourth circuits.

5. The apparatus of claim 4, wherein the third circuit includes a second normally-closed contact coupled in parallel with the trigger between the first port of the first circuit and the power terminal, and a timer circuit coupled to the seventh port and the sixth terminal wherein, upon the timer circuit being electrically connected to the power source and a passing of the first period of time, the third circuit enters the first state in which the time circuit causes the second normally-closed contact to open, and upon the timer circuit being disconnected from the power source, the second normally-closed contact closes.

6. The apparatus of claim 5, wherein the timer circuit includes a first coil, and a delay switch coupled in series with a second coil, wherein the delay switch switches from being open to being closed after the passing of the first period of time after the first coil is energized, and wherein the first coil and the delay switch are both coupled to the seventh port and the sixth terminal so that, when the third circuit is electrically connected to the power source, the first coil is energized and causes the delay switch to close after the passing of the first period of time, which in turn causes the second coil to be energized, which causes the second normally-closed contact to open.

7. The apparatus of claim 6, wherein each of the first and second circuits is an A-B 440R-ZBL220224 safety relay.

8. The apparatus of claim 6, further comprising an OFF pushbutton coupled in series between the trigger and the power terminal, and wherein the trigger is an ON pushbutton.

9. The apparatus of claim 6, wherein the contactor is a power contactor and further includes second and third normally-open main contacts and a second normally-closed auxiliary contact, wherein the first and second normally-closed auxiliary contacts are mirror auxiliary contacts, wherein the second circuit further includes:

seventh and eight terminals between which is coupled the second auxiliary contact;

a fifth normally-open contact that is in coupled in series with the fourth normally-open contact between the third and fourth terminals; and ninth and tenth terminals between which is coupled a sixth normally-open contact, wherein the ninth terminal is coupled to the first normally-open contact and the tenth terminal is coupled to the third circuit.

10. The apparatus of claim 9, wherein the fifth normally-open contact is closed when the second auxiliary contact is closed, and wherein the additional signal is only received by the third port when both the fourth and fifth normally-open contacts are closed, which indicates that none of the main contacts are welded.

11. The apparatus of claim 9, wherein the first coil and the delay switch are both coupled to the tenth terminal so that, when at least one of the first and second auxiliary circuits is closed at a time when the first normally-open contact is closed because the primary coil is energized, then the third circuit is electrically connected to the power source, the first coil is energized, the delay switch closes after the passing of the first period of time, the second coil is energized, and consequently the second normally-closed contact is opened.

12. The apparatus of claim 2, wherein the first circuit includes first, second, third, fourth, fifth, sixth, seventh, eight and ninth ports, wherein the first port is coupled to the trigger, wherein the fourth and fifth ports are coupled to one another by a third normally-open contact, wherein the eighth and ninth ports are coupled to one another by a fourth normally-open contact, wherein the fourth and eighth ports are coupled to the power terminal, wherein the third and fourth normally-open contacts close when the first circuit is in the on state;

wherein a first high voltage pickup coil is coupled to the fifth port and a second high voltage pickup coil is coupled to the ninth port, wherein the first and second high voltage pickup coils are respectively energized when the first circuit is in the on state; and wherein fifth and sixth normally-open contacts are coupled in series with one another and the primary coil, and wherein the fifth and sixth normally-open contacts are closed when the first and second high voltage pickup coils are respectively energized, causing the primary coil to be energized.

13. The apparatus of claim 2, wherein the apparatus is further for monitoring a second main contact within a second contactor, wherein the second contactor further includes a second auxiliary contact and a second primary coil, wherein energizing of the second primary coil by way of a power source causes each of the second main contact and the second auxiliary contact to switch, and wherein the apparatus further comprises:

a fifth circuit coupled to the first circuit and to the second auxiliary contact, wherein the fifth circuit prevents the additional signal from being received by the first circuit when the second auxiliary contact is open;

wherein the first circuit causes both the first and second primary coils to be energized when the first circuit is in the on state; and wherein the fourth circuit further includes a portion of the fifth circuit, wherein the fourth circuit causes the third circuit to enter the first state when at least one of:

the first circuit enters and remains in the off state for the first period of time, and at least one of the first and second auxiliary contacts remains closed for the first period of time while the first circuit is in the on state.

14. The apparatus of claim 13, wherein the fourth circuit further includes a third normally-open contact connected in series with a fourth normally-open contact to form a second series combination, the fourth normally-open contact being further included within the fifth circuit, the second series combination being coupled to the third circuit and further coupled to the power terminal;

wherein the third normally-open contact closes when the second primary coil is energized, and the fourth normally-open contact closes when the second auxiliary contact is closed, so that when the first circuit is in the on state and the second primary coil is energized but the second auxiliary contact remains closed for the first period of time, the third circuit becomes electrically connected to the power source by way of the third and fourth normally-open contacts and causes the power source to be electrically disconnected from the first circuit after the first period of time, thus causing the first circuit to switch to the off state and causing the first and second primary coils to be deenergized.

15. The apparatus of claim 14, wherein an additional normally-open contact is coupled in series with the second primary coil, and the additional normally-open contact is closed after a passing of a second period of time following the energizing of the first primary coil, so that the second primary coil is only energized after the passing of the second period of time.

16. The apparatus of claim 2, wherein the apparatus is further for monitoring a second main contact within a second contactor, wherein the second contactor further includes a second auxiliary contact and a second primary coil, wherein energizing of the second primary coil by way of a power source causes each of the second main contact and the second auxiliary contact to switch, wherein the first circuit includes first, second, third, fourth, fifth, sixth, seventh, eight and ninth ports, wherein the first port is coupled to the trigger, wherein the fourth and fifth ports are coupled to one another by a third normally-open contact, wherein the eighth and ninth ports are coupled to one another by a fourth normally-open contact, wherein the fourth and eighth ports are coupled to the power terminal, wherein the third and fourth normally-open contacts close when the first circuit is in the on state;

wherein a first high voltage pickup coil is coupled to the fifth port and a second high voltage pickup coil is coupled to the ninth port, wherein the first and second high voltage pickup coils are respectively energized when the first circuit is in the on state;

wherein fifth and sixth normally-open contacts are coupled in series with one another and the first primary coil, and wherein the fifth and sixth normally-open contacts are closed when the first and second high voltage pickup coils are respectively energized, causing the first primary coil to be energized; and wherein seventh, eighth and ninth normally-open contacts are coupled in series with one another and the second primary coil, wherein the seventh and eighth normally-open contacts are closed when the first and second high voltage pickup coils are respectively energized and the ninth normally-open contact is closed when the first primary coil is energized, thus causing the second primary coil to be energized.

17. An apparatus for monitoring a main contact within a power contactor, wherein the power contactor further includes an auxiliary contact and a coil, the apparatus comprising:

means for controlling an energizing of the coil, wherein the coil becomes energized only when the means for controlling receives both a first signal and a second signal, and wherein the coil remains energized as long as the means for controlling continues to receive the first signal;

means for determining whether the second signal is provided to the means for controlling based upon a status of the auxiliary contact;

means for preventing the first signal from continuing to be provided to the means for controlling when it is determined that, despite the energizing of the coil, the status of the auxiliary contact has not changed.

18. The apparatus of claim 17, wherein the means for preventing includes a means for providing a time delay, and wherein the first signal is a power signal.

19. In a system for monitoring a main contact of a contactor, wherein the contactor includes a primary coil and a first auxiliary contact, a method of monitoring the first auxiliary contact employed in monitoring the main contact, the method comprising:

providing a first signal to a first circuit of the system;

providing a second signal from a second circuit of the system to the first circuit if the second circuit determines that the auxiliary contact is in a first position;

switching the first circuit from an off state to an on state upon receiving the first and second signals at the first circuit, wherein in response the primary coil is energized;

providing a third signal to a third circuit of the system when, after the energizing of the primary coil, the auxiliary contact remains in the first position; and causing the first signal to no longer be provided to the first circuit in response to the third signal so that the first circuit returns to the off state and the primary coil is deenergized.

20. The method of claim 19, wherein the first signal is caused to be no longer provided when the third signal continues to be provided to the third circuit for a first period of time, and wherein the third signal is also provided to the third circuit when, after the energizing of the primary coil, a second auxiliary contact remains in the first position.

21. A power contactor comprising:

a coil having first and second ends and first and second sides connecting the first and second ends;

a first auxiliary contact supported by the power contactor along the first side of the coil;

a second auxiliary contact supported by the power contactor along the second side of the coil;

a first power contact supported by the power contactor proximate the first end of the coil nearer to the first auxiliary contact than to the second auxiliary contact; and;

a second power contact supported by the power contactor proximate the first end of the coil nearer to the second auxiliary contact than to the first auxiliary contact;

wherein each of the auxiliary contacts and power contacts are configured to switch from their respective normal statuses to their respective alternate statuses upon energizing of the coil.

* * * * *